United States Patent [19]

Sibille et al.

[11] 4,455,544

[45] Jun. 19, 1984

[54] MAGNETIC CIRCUIT AND INDUCTION DEVICE INCLUDING THE SAME

[75] Inventors: René Sibille; Pierre Gaudry, both of Bagnolet, France

[73] Assignee: LCC.CICE-Compagnie Europeene de Composants Electroniques, Bagnolet, France

[21] Appl. No.: 378,732

[22] Filed: May 17, 1982

[30] Foreign Application Priority Data

May 19, 1981 [FR] France ..... 81 09939

[51] Int. Cl.[3] ..... H01F 15/10; H01F 17/04; H01F 27/26

[52] U.S. Cl. ..... 336/65; 336/178; 336/192; 336/233

[58] Field of Search ..... 336/65, 192, 198, 208, 336/212, 233, 234, 96, 178

[56] References Cited

U.S. PATENT DOCUMENTS

| | | | |
|---|---|---|---|
| 31,238 | 7/1899 | Freeman | 336/233 |
| 2,599,068 | 6/1952 | Potter | 336/233 X |
| 3,585,553 | 6/1971 | Muckelroy | 336/192 |
| 3,593,217 | 7/1971 | Weber | 336/65 X |
| 3,824,518 | 7/1974 | Slenker | 336/192 X |
| 3,947,796 | 3/1976 | Postma et al. | 336/212 X |
| 4,064,472 | 12/1977 | Gunewardena et al. | 336/96 X |
| 4,314,221 | 2/1982 | Satou et al. | 336/212 X |

FOREIGN PATENT DOCUMENTS

| | | | |
|---|---|---|---|
| 768777 | 10/1967 | Canada | 336/233 |
| 2247017 | 3/1974 | Fed. Rep. of Germany | 336/233 |
| 3042433 | 7/1982 | Fed. Rep. of Germany | . |
| 1587574 | 3/1970 | France | . |

*Primary Examiner*—Thomas J. Kozma

*Attorney, Agent, or Firm*—Cushman, Darby & Cushman

[57] ABSTRACT

The invention relates to a magnetic circuit for inductance devices, to an induction device incorporating such circuit, as well as a process for producing the above-mentioned circuit. The novel magnetic circuit is constituted by a parallelepipedic bar of magnetic material comprising at least two substantially superimposed grooves. This circuit is substantially H-shaped in a plane perpendicular to said grooves. The lower branches of the H, delimiting the lower groove or grooves, are provided with electrical connection means. Consequently, the induction devices thus obtained may be easily and efficiently fixed onto printed circuits, or directly fixed onto hybrid circuit supports. The induction devices thus produced are particularly adapted to be miniaturized.

8 Claims, 13 Drawing Figures

MAGNETIC CIRCUIT AND INDUCTION DEVICE INCLUDING THE SAME

SUMMARY DEFINITION OF THE FIELD OF THE INVENTION

The present invention is related to a magnetic circuit for an induction device; it is also related to an induction device using such circuit, as well as to a process for producing such magnetic circuit with a view to manufacturing the above induction device.

BACKGROUND OF THE INVENTION

Induction devices, and more particularly miniaturized high frequency induction devices are generally manufactured by winding a coil of enamelled copper wire in the groove of a magnetic spool made of ferrite or iron powder. This spool is generally produced either by injecting or moulding magnetic powder mixed with a thermoplastic or thermosetting material, or by machining (grinding) a cyclindrical bar by means of a diamond grinding wheel. In this latter case a plurality of gooves may be ground successively or simultaneously in one cylindrical bar. A certain number of grooves regularly distributed over the bar are thus obtained, and the copper wire is wound in these grooves. Such wire winding operation may be performed on the entirety formed by the spools constituting the bar, each individual spool then being obtained by cutting the bar into sections.

However, such spools are not adapted to be welded directly on printed circuits. Indeed, the two ends of the induction device are constituted by flexible copper wires, and it is difficult to introduce the same directly into the holes of the printed circuits; furthermore, their rigidity is not sufficient to eliminate the risk of rupture or unsoldering of the wires when the circuit is subjected to vibration. With a view to overcoming this drawback, such induction devices are generally encased in a housing or in a consecutively moulded resin envelope.

SUMMARY DEFINITION OF THE OBJECTS OF THE INVENTION

It is one of the main objects of the present invention to overcome these and other drawbacks of the known devices and processes of the kind considered herein.

To this end the invention provides a magnetic circuit constituted by a parallelepiped comprising at least one upper groove and at least one lower groove substantially located above each other and adapted to receive a coil, the circuit having substantially the shape of an H in a plane perpendicular to the grooves.

As will be shown hereinafter, such a magnetic circuit enables inductance devices adapted to be mounted directly on a printed or hybrid circuit to be easily produced.

In a preferred embodiment of the circuit, the two grooves have different respective widths. In fact, the magnetic circuit according to the present invention is preferably provided, at its lower end, with electrical connection means which may be constituted, for example, by metal layers deposited directly on the two branches delimiting the lower groove, or by metallic substrates fixed under the two branches. Thus the upper groove, the width of which is smaller than that of the lower groove, allows the eddy currents (or Foucault currents) in the lower metallic portions to be limited to minimum values, and enhances in an optimum manner the passage of the magnetic flow in the upper air space or gap, which corresponds to the portion of the circuit in which the reluctance has a minimum value. This effect is still more enhanced when the branches delimiting the lower group are longer than the branches delimiting the upper groove.

The electrical connecting means mentioned and defined hereinabove may have various forms: they may be constituted, for example, by metal layers deposited directly onto the branches delimiting the lower groove. The connecting means may also be constituted by metallic lugs adapted to the printed circuit, such lugs being glued directly onto the magnetic core or being glued on the core with an isolating layer interposed between the core and the lugs.

The present invention also relates to a magnetic induction device comprising a magnetic circuit of the kind defined hereinabove and provided with a convenient coil arrangement, wherein the coil ends are electrically connected to the above-mentioned electrical connecting means.

The invention furthermore is related to a process for producing magnetic circuits for induction devices, wherein a plurality of grooves are provided in a magnetic bar, as well as a plurality of magnetic circuits which are then separated from each other between any two adjacent grooves, the bar being a parallelepipedic bar in which a plurality of grooves are provided on the upper and lower surfaces of the bar, said grooves being substantially parallel to each other and substantially aligned vertically by pairs.

The grooves may be formed by sequential or simultaneous horizontal grooving or pressing, and any convenient means well known to those skilled in the art may be used to this end.

In a preferred embodiment of the invention electrical connection means are provided on the lower portions of the bar which are located between the lower grooves, prior to the separation of the magnetic circuits. Preferably, the selected parallelepiped has a rectangular section, and the grooving is effected in a parallel manner to the lateral plane of the bar, whereby after the separation of the magnetic circuits, the resulting circuits have the shape of an H in a plane perpendicular to the lateral plane of the bar.

The invention will be described herein-below in more detail, especially with reference to several embodiments of the invention and to the appended drawing, which embodiments and drawing are given by way of illustration, but not of limitation.

SUMMARY DESCRIPTION OF THE DRAWING

DETAILED DESCRIPTION OF PREFERRED EMBODIMENTS OF THE INVENTION

Figure 1:
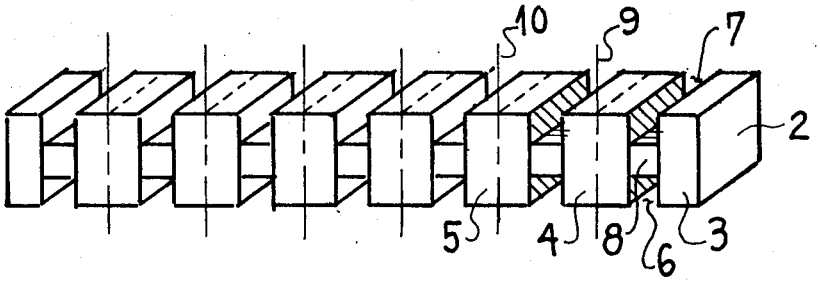
FIG. 1 shows a parallelepipedic bar after grooving, forming a plurality of magnetic circuits.

As shown in FIG. 1, parallelepipedic bar 1 having a lateral rectangular surface 2 has been submitted to a grooving operation wherein a plurality of upper grooves such as 7 and lower grooves such as 6 have been formed. Said grooves are separated from each other by plain or solid portions 8. The non grooved portions of the front face of parallelepiped 1, such as 4 and 5, are then cut along symmetry axes 9 and 10, whereby H-shaped magnetic circuits according to the invention are obtained.

Figure 2:
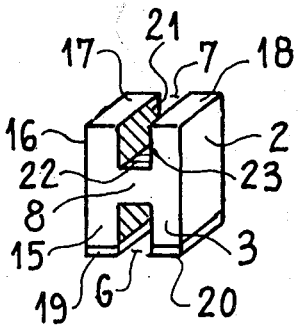
FIG. 2 shows a magnetic circuit obtained by using the bar of FIG. 1.

FIG. 2 shows one of the magnetic circuits obtained after cutting the bar shown in FIG. 1. The reference numerals in FIG. 2 designate the same elements as the identical reference numerals used in FIG. 1. Groove 7 has two vertical walls 21 and 23 and a horizontal wall 22, which walls delimit the central or plain portion 8 of the magnetic circuit. Lower groove 6 has walls arranged in the same manner at those of groove 7. Upper groove 7 is delimited by two upper branches 17 and 18, while lower groove is delimited by two lower branches 15 and 3. As shown, each one of the lower branches is provided with connecting means 19, 20 which are constituted, in the present embodiment, e.g. by depositing a metallization layer, such as a silver-containing paste, and consecutive baking the same by a convenient process.

Figure 3:
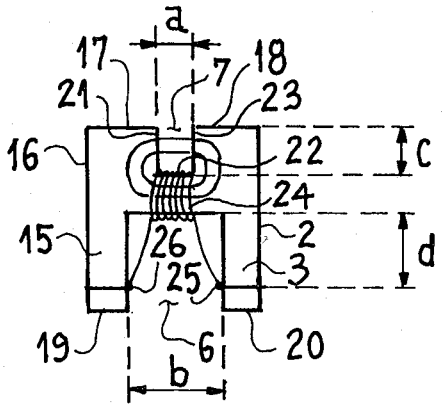
FIG. 3 shows a magnetic induction device obtained by using a magnetic circuit according to the present invention.

FIG. 3 shows a magnetic circuit similar to that of FIG. 2, similar elements being designated by similar reference numerals. FIG. 3 furthermore shows a coil 24 constituted by a plurality of windings provided within grooves 6 and 7; the ends 25 and 26 of said coil are connected by connecting means 20, 19, respectively. in the embodiment shown in this Figure the width a of upper groove 7 is substantially smaller than the width b of lower groove 6. As explained hereinbefore such an arrangement enhances or facilitates to a maximum the flow in the upper gap, which corresponds to that portion of the circuit which has the lowest reluctance (or magnetic resistance). Preferably the ratio of the width b defined between the lower branches or legs to the width a defined between the upper branches or legs is comprised between 1.5 and 3. Furthermore, with a view to also limiting any losses due to eddy currents to a minimum, the lower branches 15 and 3 are elongated. Preferably the ratio of the length (or height) d (c.f. FIG. 3) of the lower branches to the length (or height) c of the upper branches is comprised between 1.5 and 2, this ratio being equal to about 2 in the most preferred embodiment.

Figure 4:
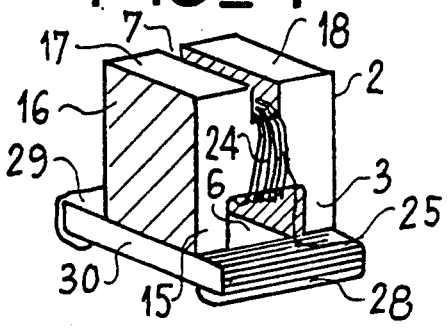
FIG. 4 shows another embodiment of the magnetic induction device according to the invention, comprising connecting means for a hybrid circuit.

FIG. 4 is a perspective view of an induction device such as the one shown in section in FIG. 3; this device comprises electrical connecting means particularly adapted to allow the device to be fixed onto a hybrid circuit support. The coil ends such as 25 are connected respectively to metallized ribbons such as 28 and 29, the connection being made in the prolongation of the axis of groove 7. The electrical connection between the end 25 and the metallized ribbon 28 is thus located substantially in the middle of the latter. In this embodiment, the magnetic circuit is fixed onto an isolating support or carrier, such as 30, by means of a convenient adhesive product or glue, such as epoxy-polyurethane or the like, said isolating support comprising metallized ribbons 28 and 29. With a view to reducing the size of such magnetic circuits, the lateral rectangular surface 16 of the circuit is located in the prolongation of the lateral face of the isolating support 30.

Figure 5:
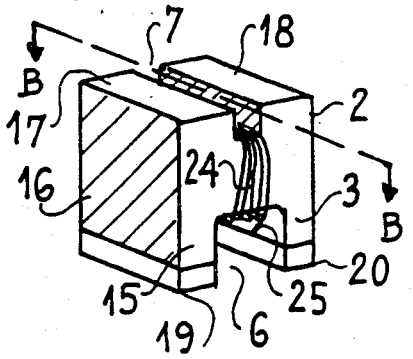
FIG. 5 shows an induction device provided with weldable metallic shoes, as well as a sectional view thereof taken at the level of the grooves.
Figure 5:
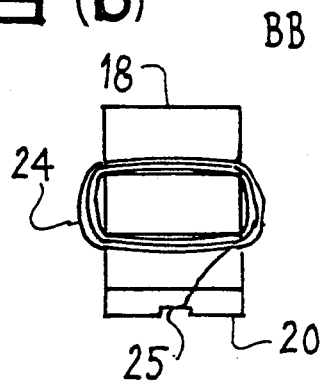

FIG. 5*a* shows another embodiment of the electrical connecting means mounted onto the lower lugs of the magnetic circuit. In this embodiment the electric connections 19 and 20 are made by means of a metallic deposit, such as silver-containing paste. Coil ends 25 and 26 are then welded electrically onto connections 19 and 20 which have previously been tinned, as shown in FIG. 5*b* which is a sectional view taken along the axis B—B of the magnetic circuit as shown in FIG. 5*a*.

Figure 6:
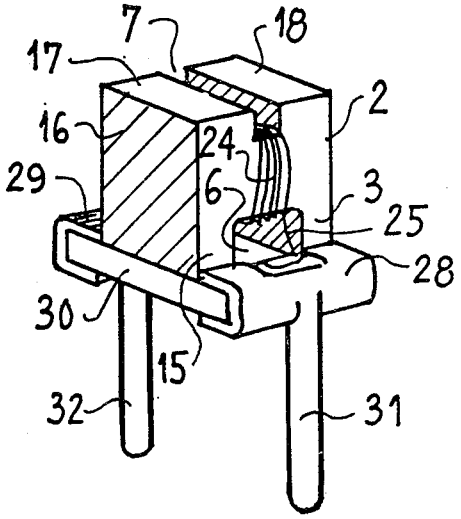
FIG. 6 shows another embodiment of the magnetic induction device according to the invention, provided with lugs for connection with a printed circuit.

FIG. 6 shows another embodiment of the circuit represented in FIG. 4; this variant is different only by the provision of two radial terminal lugs 31 and 32 for connection to a printed circuit, said terminal lugs being connected respectively to electrical connecting means 28 and 29.

Figure 7:
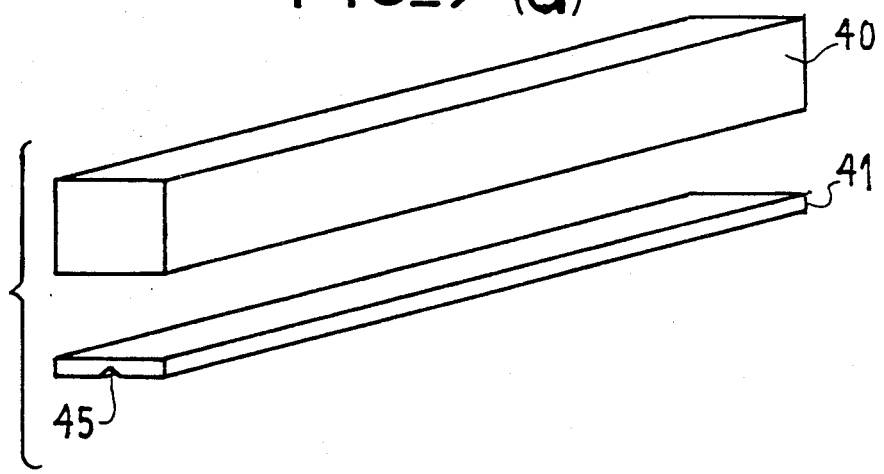
FIG. 7 illustrates an embodiment of the process according to the invention.
Figure 7:
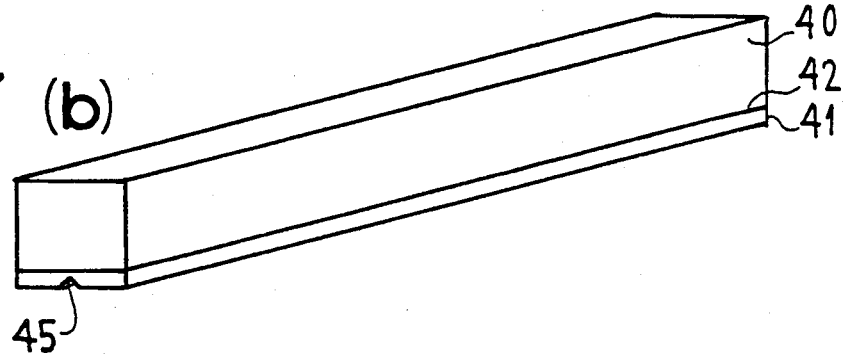
Figure 7:
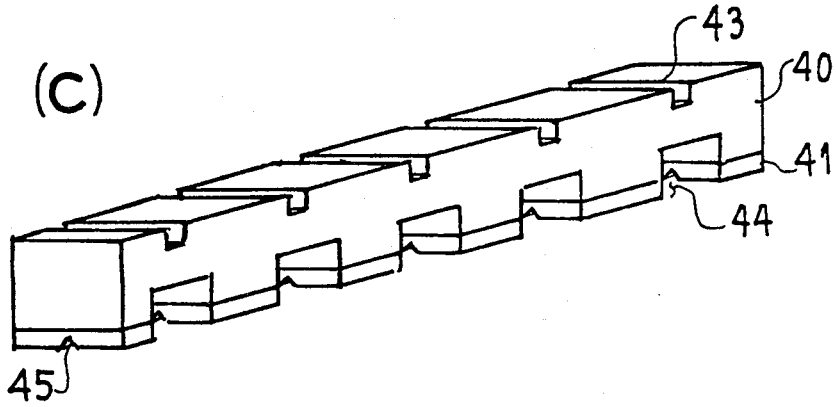
Figure 7:
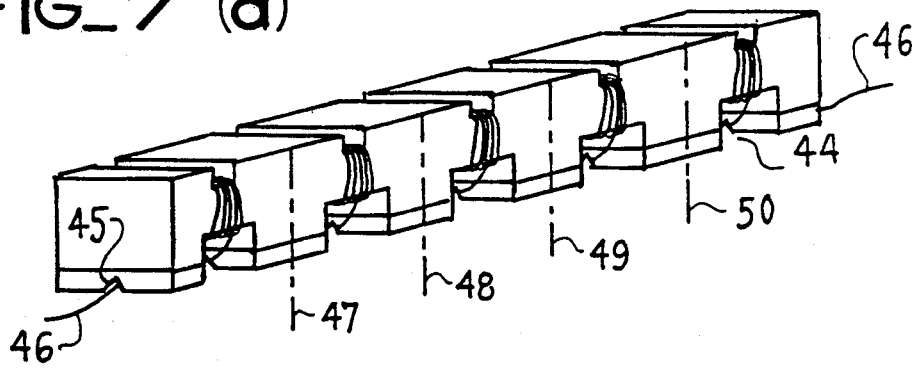
Figure 7:
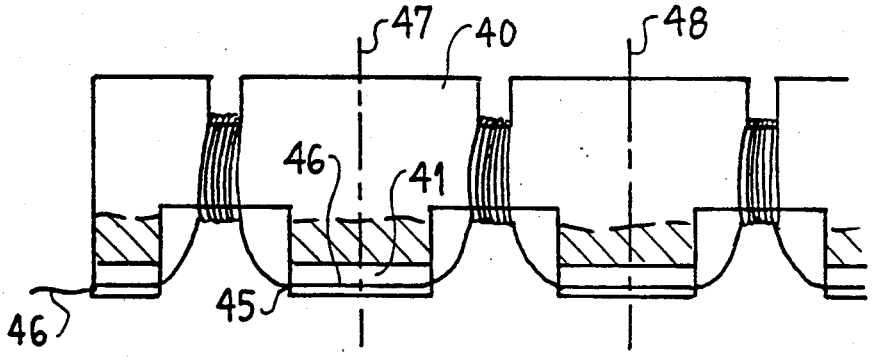
Figure 7:
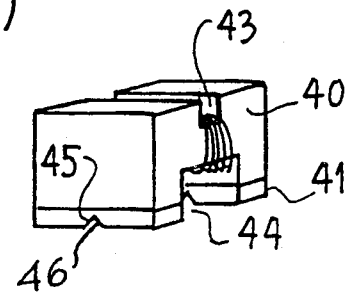

FIG. 7 shows the various steps of another embodiment of the process according to the invention.

A parallelepipedic magnetic bar 40 and a metallized metallic substrate 41 (cf. FIG. 7*a*) are assembled by their surfaces of common dimensions (cf. FIG. 7*b*) e.g. by means of a layer of glue 42. Metallic substrate 41 is provided at its lower surface with a groove 45 extending over its entire length parallely to the longer side of substrate 41.

This assembly is then grooved as explained hereinabove with reference to FIG. 1, so as to form units provided with mutually parallel grooves, namely: upper grooves 43 and lower grooves 44 (cf. FIG. 7*c*). The inductance coils are then produced by means of a single enamelled copper wire 46 which is first introduced into the groove 45 and then welded therein (cf. FIG. 7*d*) and wound or bobbined in grooves 43 and 44 in accordance with the desired number of windings, etc; the welding of wire 46 in groove 45 may be carried out sequentially or simultaneously. Thus-as shown in FIG. 7*e*-a series of induction devices will be obtained, which are to be severed along the axes 47, 48, 49, 50 (cf. FIGS. 7*d* and 7*e*).

As clearly shown, especially in FIG. 7*e* wire 46 is embedded in groove 45, whereby it is possible to deposit, e.g. a silver-containing paste onto each "foot" of an induction device and to weld the same onto a printed circuit.

FIG. 7*f* shows the induction device obtained after cutting or severing along axes 47, 48 . . . .

The invention is not limited to the embodiments shown and described herein-above; many modifications and variations may be envisaged by those skilled in the art without departing from the spirit and scope of the invention as defined in the appended claims.

What is claimed:

1. A magnetic circuit for an induction device having a parallelepipedic bar comprising a pair of electrical connecting means for establishing electrical connection with said bar, upper and lower pairs of leg means respectively defining one upper groove and at least one lower groove, the width of said upper groove being smaller than the width of said lower groove to enhance to a maximum extent the magnetic flux in said upper groove, said upper and lower grooves being substantially located above one another and adapted to receive a coil, said circuit being substantially H-shaped in a plane perpendicular to said grooves, and an isolating layer fixed to said lower pair of leg means and separating said pair of electrical connecting means.

2. A magnetic circuit according to claim 1, wherein the lower part of two branches delimiting said lower groove is provided with said electrical connecting means.

3. A magnetic circuit according to claim 1, wherein said each of said pair of electrical connecting means are formed by metallic deposits.

4. A magnetic circuit according to claim 1, wherein said electrical connecting means are constituted by metallic lugs for connection with a printed circuit.

5. A magnetic circuit according to claim 1 wherein the lower leg means defining said lower groove have a length greater than the upper leg means defining said upper groove.

6. A magnetic circuit as in claim 1 wherein the ends of said isolating layer extend beyond the sides of said bar and wherein each one of said pair of electrical connecting means includes a pair of metalized areas at each respective end of said isolating layer, each of said metalized areas being a continuous strip extending from the top of said isolating layer to the bottom thereof to facilitate the fixing of said circuit onto a hybrid circuit support.

7. A magnetic circuit as in claim 1 wherein said pair of electrical connecting means includes a pair of radial terminal elements for connection to a printed circuit.

8. An induction device comprising a magnetic circuit having a parallelepipedic bar including upper and lower leg means defining opposing upper and lower grooves, respectively, in said bar, the width of said upper groove being smaller than the width of said lower groove, an isolating layer fixed to said lower leg means, a coil disposed in said upper and lower grooves, and electrical connection means fixed to said isolating layer for establishing electrical connection with said coil.

* * * * *